US006431111B1

(12) United States Patent
Zhang

(10) Patent No.: US 6,431,111 B1
(45) Date of Patent: Aug. 13, 2002

(54) APPARATUS AND METHOD FOR DISPENSING TOWELS

(75) Inventor: Ben Zhang, Xili Nanshan (CN)

(73) Assignees: HotTowels LLC, Marietta, GA (US); Shenzhens Bens Towel Dispenser (CN)

( * ) Notice: Subject to any disclaimer, the term of this patent is extended or adjusted under 35 U.S.C. 154(b) by 0 days.

(21) Appl. No.: 09/714,015

(22) Filed: Nov. 16, 2000

Related U.S. Application Data

(60) Provisional application No. 60/205,386, filed on May 19, 2000.

(51) Int. Cl.[7] ..... B05C 11/00

(52) U.S. Cl. ..... 118/43; 118/419; 118/423; 134/198; 134/26; 312/34.1

(58) Field of Search ..... 118/43, 235, 419; 134/198, 18, 26, 15, 40, 39; 312/34.1

(56) References Cited

U.S. PATENT DOCUMENTS 3,730,409 A 5/1973 Ratti
3,778,963 A * 12/1973 Straujups et al. ..... 53/66
4,984,530 A 1/1991 Dutton
5,443,084 A 8/1995 Saleur
5,526,973 A * 6/1996 Boone et al. ..... 225/34
5,573,318 A * 11/1996 Arabian et al. ..... 312/34.12
5,736,714 A 4/1998 Bechtold, Jr.
5,772,291 A 6/1998 Byrd et al.

OTHER PUBLICATIONS

Search Report re: Application No. PCT/US/00/32273; dated Mar. 29, 2001.

* cited by examiner

*Primary Examiner*—Laura Edwards
*Assistant Examiner*—Yewebdar T. Tadesse
(74) *Attorney, Agent, or Firm*—Cook, Alex, McFarron, Manzo, Cummings & Mehler, Ltd.

(57) ABSTRACT

A towel dispensing machine for dispensing wet towels, including a cutting mechanism to cut the towels to the desired length and a liquid dispensing device for wetting the towels to produce individual cut, wet towels. Preferably, the towels are also rolled by a rolling mechanism before being dispensed. Additionally, the liquid can be heated to dispense hot wet towels. A method for producing wet towels is also disclosed.

23 Claims, 8 Drawing Sheets

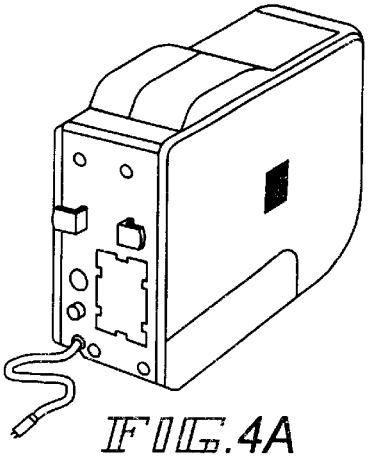
FIG.4A
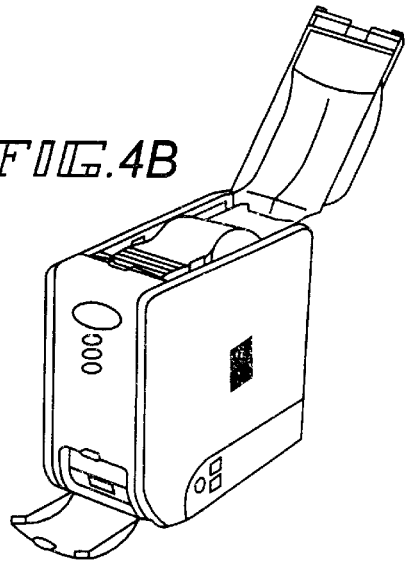
FIG.4B
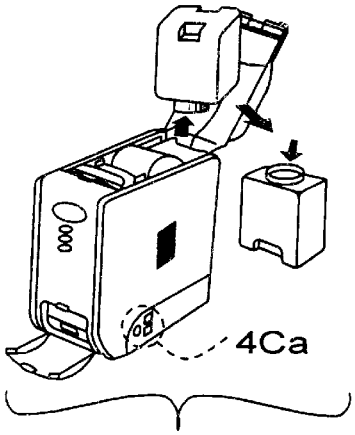
FIG.4C
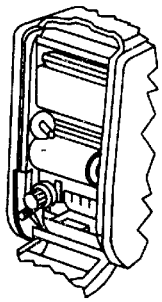
FIG.4E
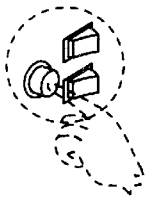
FIG.4Ca
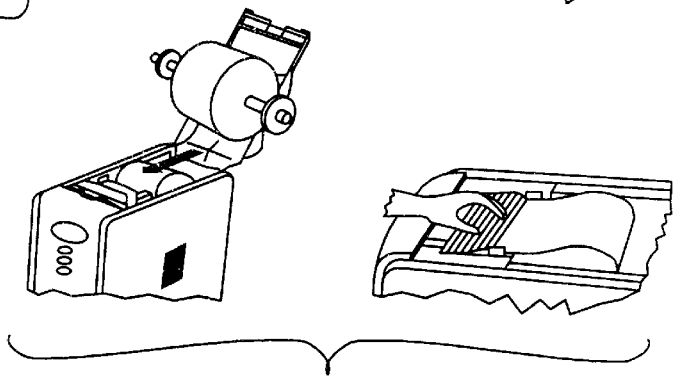
FIG.4D
FIG.4F
FIG.4G
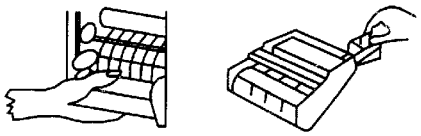
FIG.4Fa
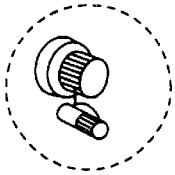
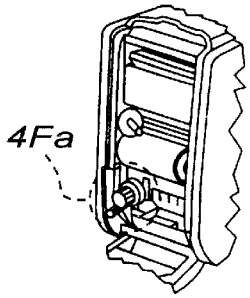

APPARATUS AND METHOD FOR DISPENSING TOWELS

This application claims priority from provisional application Ser. No. 60/205,386, filed May 19, 2000.

BACKGROUND OF THE INVENTION

The present invention is directed to a towel dispensing machine that preferably dispenses wet towels and a method for dispensing such towels.

Up until now, places such as restaurants, fast food locations, bars, etc. provided their patrons with dry paper or cloth napkins. Such napkins do not work very effectively for cleaning hands and faces before or after eating. Some places such as first class service on an airplane provide wet, hot cloth towels but do not have an efficient or economical way for providing such hot towels to the rest of the passengers on the airplane. Such towels, also, have to be washed, rolled and heated. Further, such towels are not disposable, cannot be customized, are not ready on demand and are costly. The airlines are also extremely limited in the number of towels that can be provided to such patrons. Alternatively, some places such as rib joints provide wash & dry towels in little packages. Such packages, however, cannot provide hot towels but instead the wipes are cold. Further, such packages are costly as one is usually not enough per customer. The packages also often become open, lose their wetness and need to be thrown out. In addition, a necessary supply of such packages uses a lot of space.

The present invention is intended to overcome these deficiencies.

SUMMARY OF THE INVENTION

The present invention is directed to a towel dispensing machine. More particularly, the present invention is preferably directed to a machine for dispensing wet, preferably hot, towels. Such towels can be used, for example, in restaurants, bars, hotels, gyms, locker rooms, exercise rooms, air planes, hospitals, country clubs, break rooms, pool areas, rest rooms, fast food locations, homes or anywhere a person wants to clean their hands or face or even to use the towels for other types of cleaning.

In a preferred embodiment, the machine includes a cutting mechanism for cutting the towels to the size desired by the owner of the machine and a liquid dispensing device for wetting the towels. In a further embodiment, the machine includes either a roll for uncut towels on a disposable core or a core in which a roll of towels can be placed. In addition, the liquid dispensing device can include a container of liquid. In operation of an example embodiment of this invention, a person desiring a towel, requests a towel by pushing a button or activating the automatic dispenser, and the machine cuts a towel to the desired length, wets the towel and outputs it to the person. In a further embodiment, the machine rolls the towel before outputting it. In still a further embodiment, the towels are wetted with a hot liquid.

The person receiving the towel can then use the towel to clean his hands or face (or anything the person desires to clean) and then discard the towel. Because the towel is not used by others, there is little risk of spreading germs from using another's towel.

The machine can be used, for example, in the service industry as a convenient and efficient way for dispensing towels to be provided to patrons to be used as a more effective way for cleaning their hands and faces or even the table they are sitting at.

The present invention is also directed to a method for dispensing such towels.

BRIEF DESCRIPTION OF THE DRAWINGS

In describing the preferred embodiments, reference is made to the accompanying drawings:

FIGS. 4A–4G illustrates the operation and components of an embodiment of the machine of the present invention;

DETAILED DESCRIPTION OF THE PRESENTLY PREFERRED EMBODIMENTS

Figure 1A:
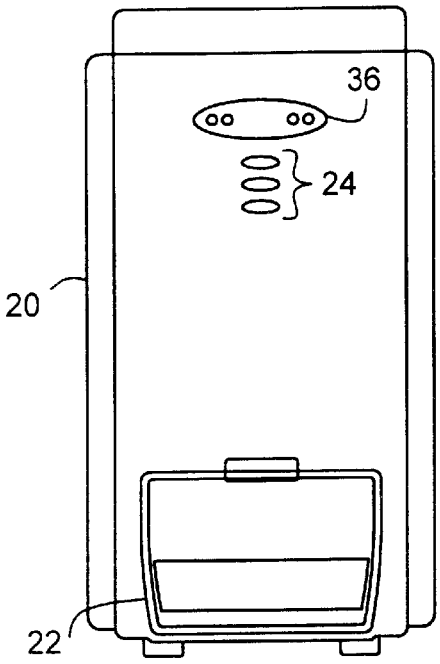
FIGS. 1A–1D show the outside of the housing of an embodiment of the towel machine of the present invention.
Figure 1C:
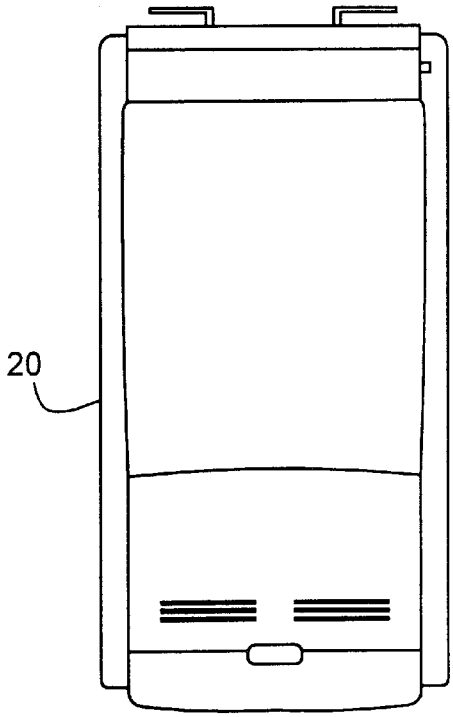
Figure 1B:
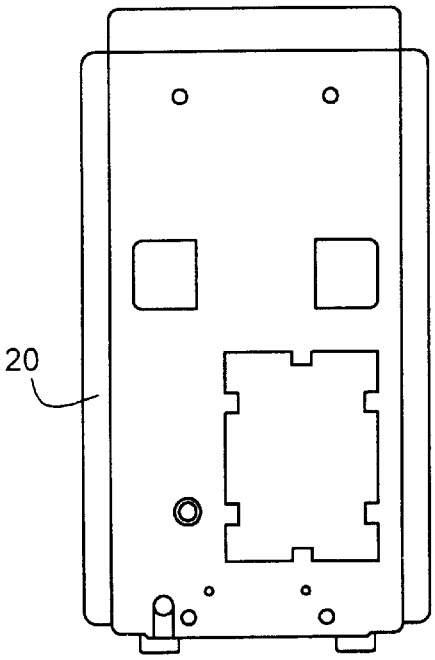
Figure 1D:
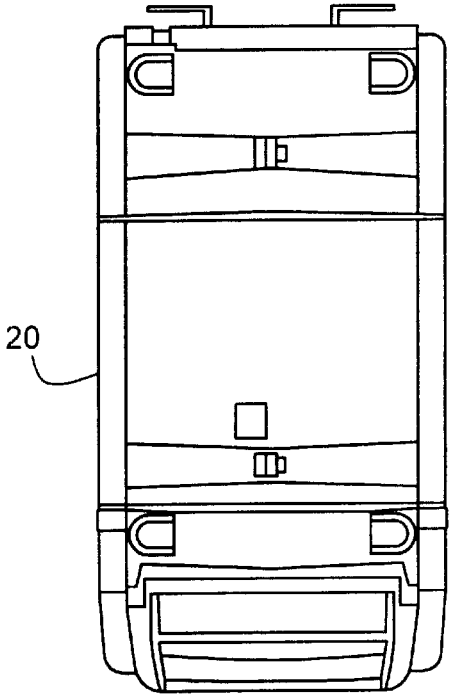

In general, FIG. 1 shows the housing or outside structure of a towel machine 20 of an embodiment of the present invention. The embodiments shown and described herein are provided for illustrative purposes and are not intended to limit the present invention. FIG. 1(*a*) shows a front view; FIG. 1(*b*) shows a rear view; FIG. 1(*c*) shows a top view; and FIG. 1(*d*) shows a bottom view of the housing of this embodiment.

In a preferred embodiment, the housing can be made of plastic. Alternatively, the housing could be made of other materials such as for example, metal. Preferably, the device is a size which can fit on a counter without taking up too much space. In an example embodiment, the height from the top to the bottom of the machine is 460 millimeters, the width 230 millimeters, and the length or depth is 530 millimeters. The present invention, however, is not limited to a particular size as this size is merely described for example purposes. In fact, within reason, the machine can be made to whatever size is desired by the consumer.

As shown in FIG. 1(*a*), the machine 20 has an opening 22 wherein towels are outputted from the machine. As also shown in FIG. 1(*a*), the machine preferably has buttons or a similar type of device 24. The buttons 24 can be pushed to output a towel, or more preferably to output as many towels as the operator would like to be delivered at one time. For example, if the operator wishes to have five towels distributed, he can push the appropriate buttons 24 for five towels to be delivered sequentially at one time. Alternatively, the operator can push the button 24 to have just one towel delivered at a time. The present invention, however, is not limited to the particular type of buttons used for a towel to be dispensed as is contemplated that one skilled in the art would appreciate that other similar types of devices could be used to request towels. A sensing mechanism could also be used to sense movement in front of the button area and dispense a towel automatically when movement is sensed in front of the machine. FIG. 1A also shows an optional indicator 36 which is explained infra. In addition, the machine could also include a code punch pad. The machine could also be coin operated wherein the user inserts a coin(s) which activates the machine to output a wet towel.

Figure 2A:
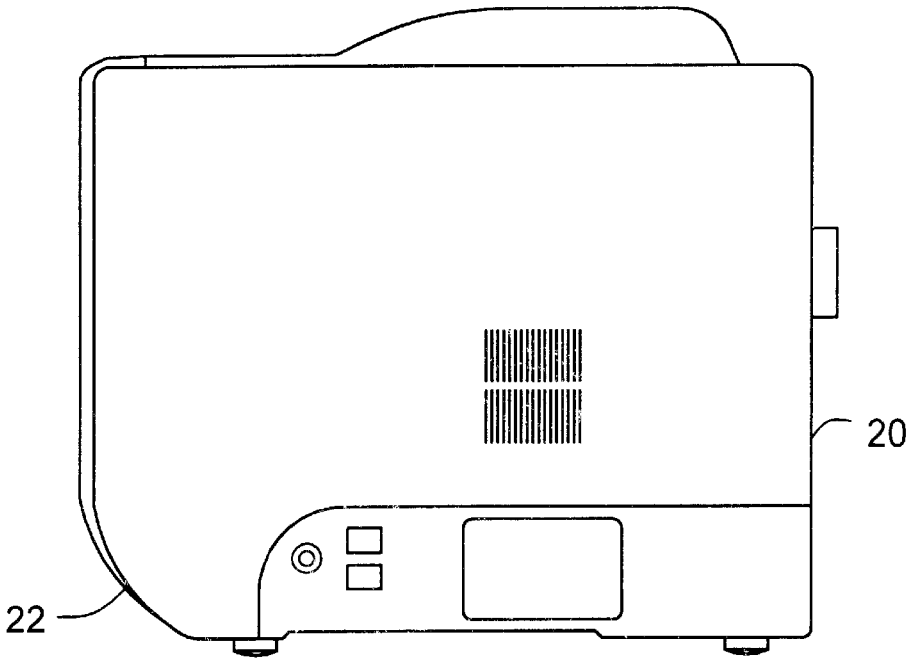
FIGS. 2A and 2B show the right side view and left side view of the housing of an embodiment of the machine of the present invention.
Figure 2B:
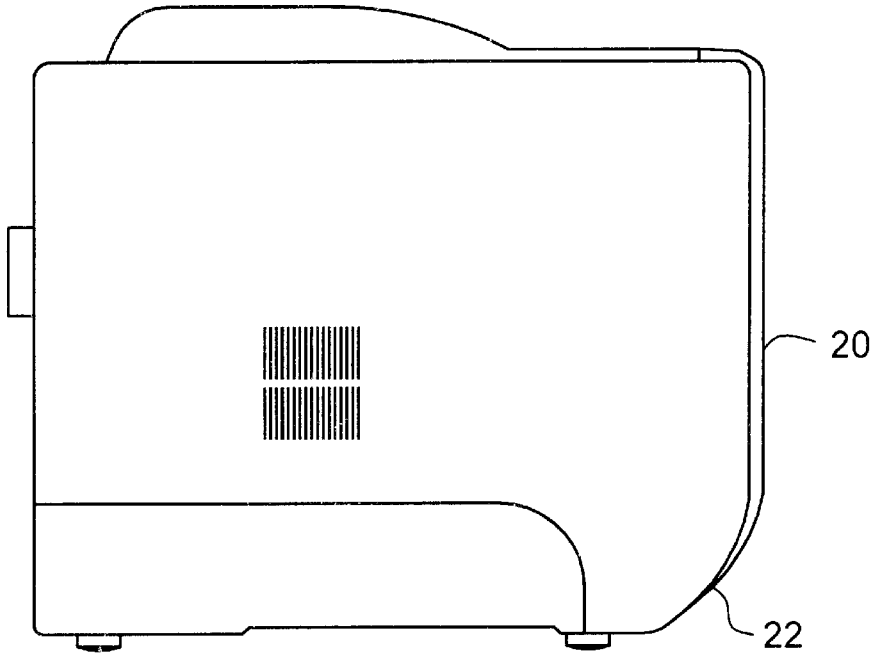

FIGS. 2(*a*) and 2(*b*) show the right side view and left side view, respectively, of the housing an embodiment of machine 20.

Figure 3:
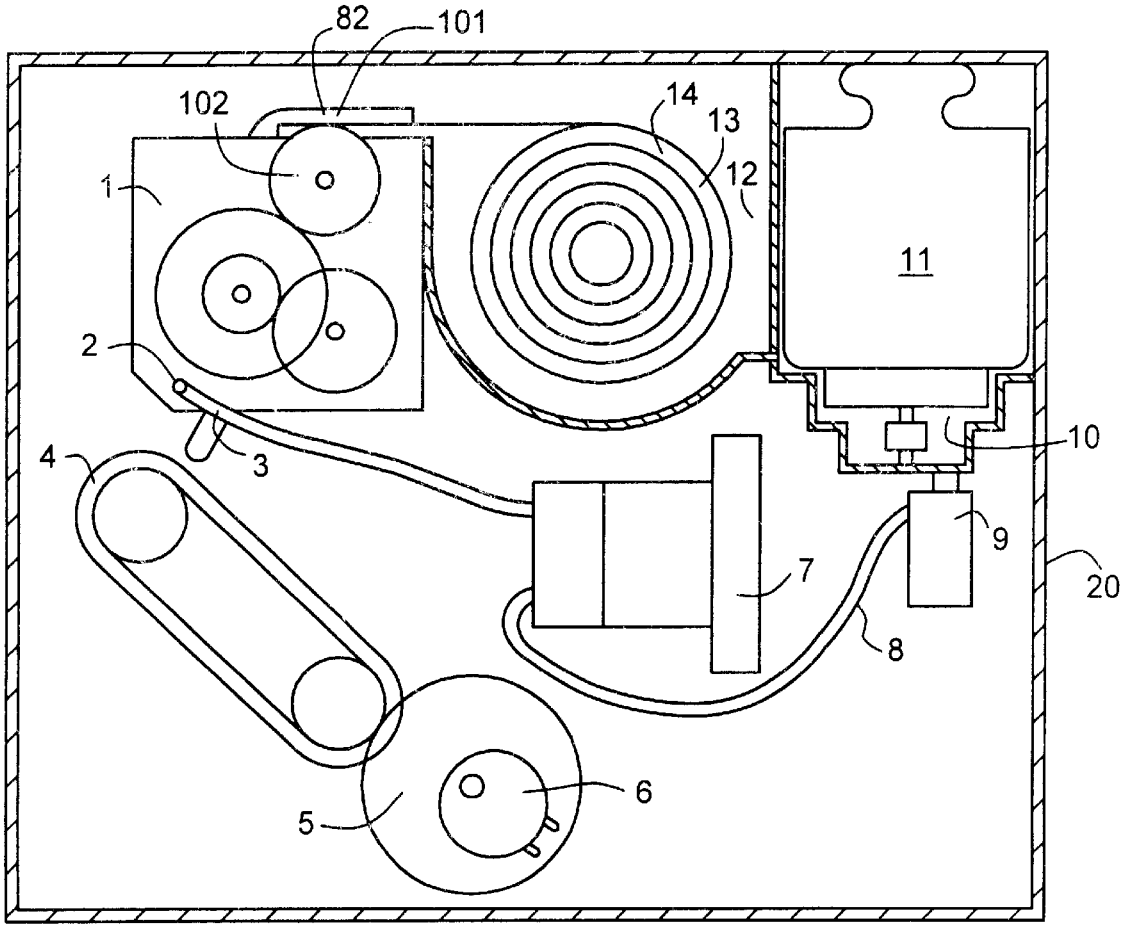
FIG. 3 illustrates the internal components of an embodiment of the machine of the present invention.

FIG. 3(*a*) illustrates a preferred embodiment of the components inside machine 20. As explained in more depth below, this embodiment is directed to a fully automatic digital control nonwoven fabric cutting mechanism which includes a fabric chamber, a cutting mechanism, a rolling (motor plus gear box) mechanism, and a liquid dispensing device including a liquid container, a container base, a filter, a pump, a hose, a heating mechanism, a spraying mechanism and a control mechanism. This embodiment will now be explained in more detail.

Figure 6:
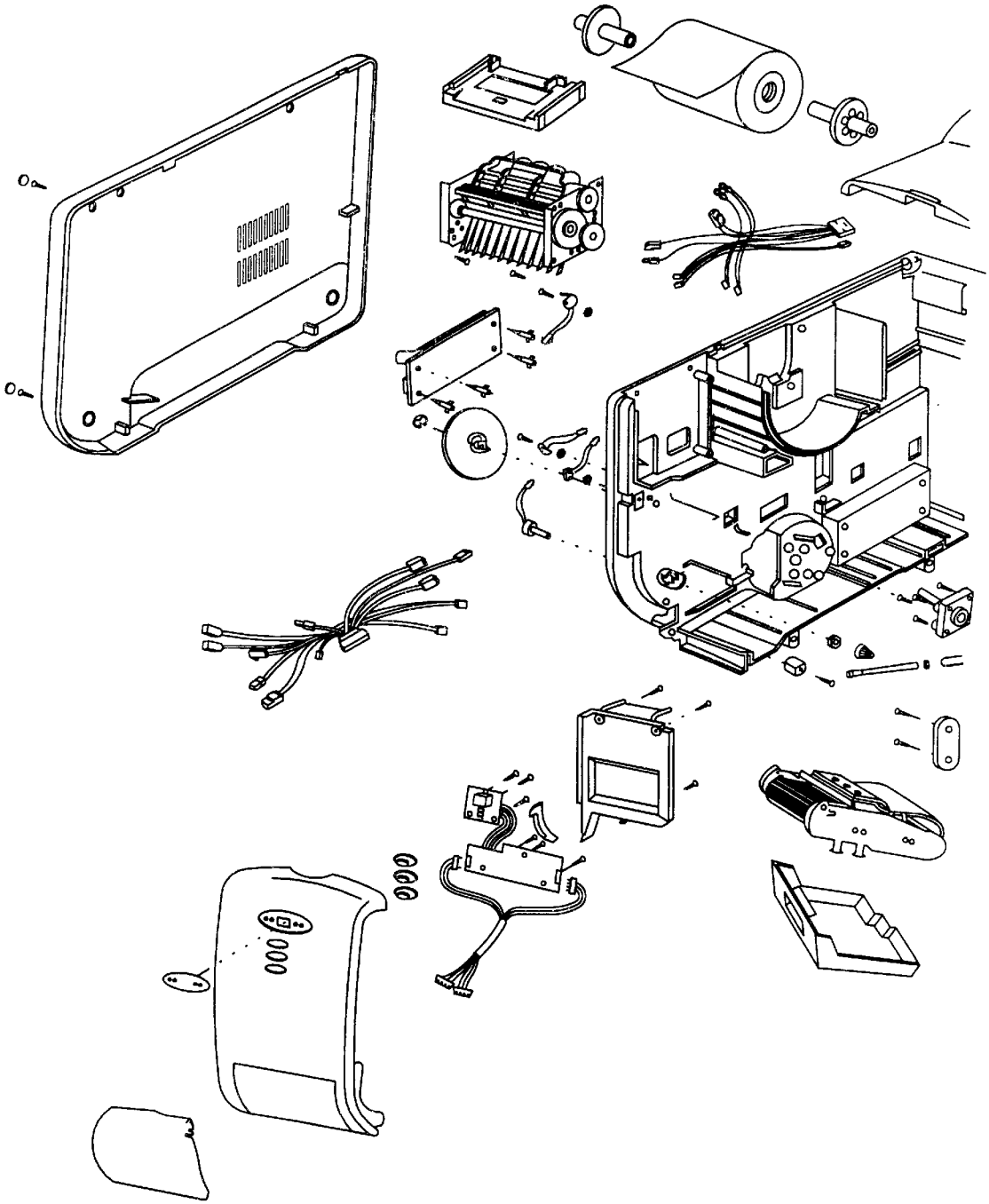

The device shown in FIG. 3 includes a fabric chamber 12. Inside fabric chamber 12 is a detachable or removable fabric roll 13. Preferably, fabric roll 13 is on a removable core, as discussed infra. Fabric roll 13 includes the core 15 and a roll of towels 14 placed on the core 15, as also shown in FIG. 6. The core could be either permanent (e.g. needs only to be replaced when worn out) or a disposable one. Applicants have not shown minor details, such as for example screws, in these drawings as these details would be obvious to one skilled in the art. Many of these details are shown in provisional application No. 60/205,386 filed May 19, 2000 for which this application is based and which is incorporated herein by reference. As explained in more depth infra, fabric roll 13 can be placed in fabric chamber 12. Preferably, the roll of towels 14 in fabric roll 13 is uncut and is made out of a cloth material. An example of such cloth material could be either rayon, cotton or other similar type of material. The invention, however, is not limited to the type of material of the towel as one skilled in the art would appreciate that other types of materials could also be used and still fall within the scope of the invention.

Figure 8:
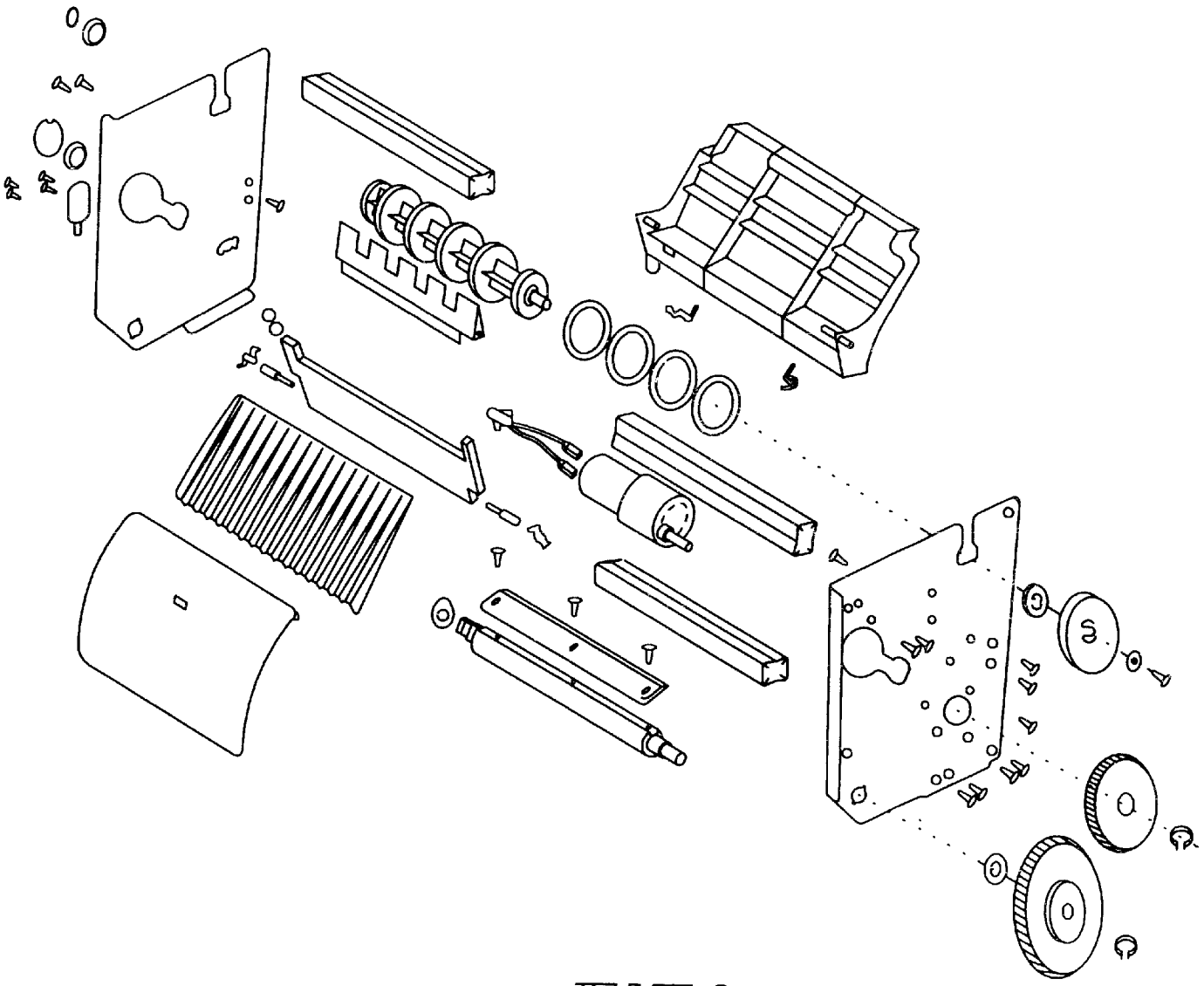
FIG. 8 illustrates an exploded view of some of the components of the feeding mechanism of an embodiment of the machine of the present invention.

FIG. 3 also illustrates a cutting mechanism 1 inside machine 20. A more detailed drawing of the cutting mechanism is shown in FIGS. 6 and 8. The cutting mechanism is used to cut towels from fabric roll 13 into a desired length. The cutting mechanism 1 has a fabric director 101, and a fabric transportation system 102. The fabric director 101 takes the uncut towels from the fabric roll 13 and directs the uncut towels into the cutting mechanism 1. The fabric transportation system 102 takes the uncut towel and cuts it into the desired length. Within the fabric transportation system 102 in an example embodiment of the present invention, are gears 103 and rollers 104, a cutting apparatus 105 including at least one cutting blade, a motor 106 and a control device for adjusting the length of the cut towel. The gears 103, rollers 104 and motor 106 feed and guide the uncut towel through the fabric transportation system to the cutting apparatus 105. The blade in the cutting apparatus 105 then cuts a length of towel which is then output out of the system 102. The control device is used to adjust the length of the cut towel, as desired.

In a example embodiment, the cutting mechanism 1 is preferably operated at 12 volts DC voltage. The present invention is not limited to the length of the towels cut. It is contemplated that the machine will be designed so that the length of the towel can be cut to whatever is desired for the towels intended application or the length desired by the consumer of the machine.

Figure 5:
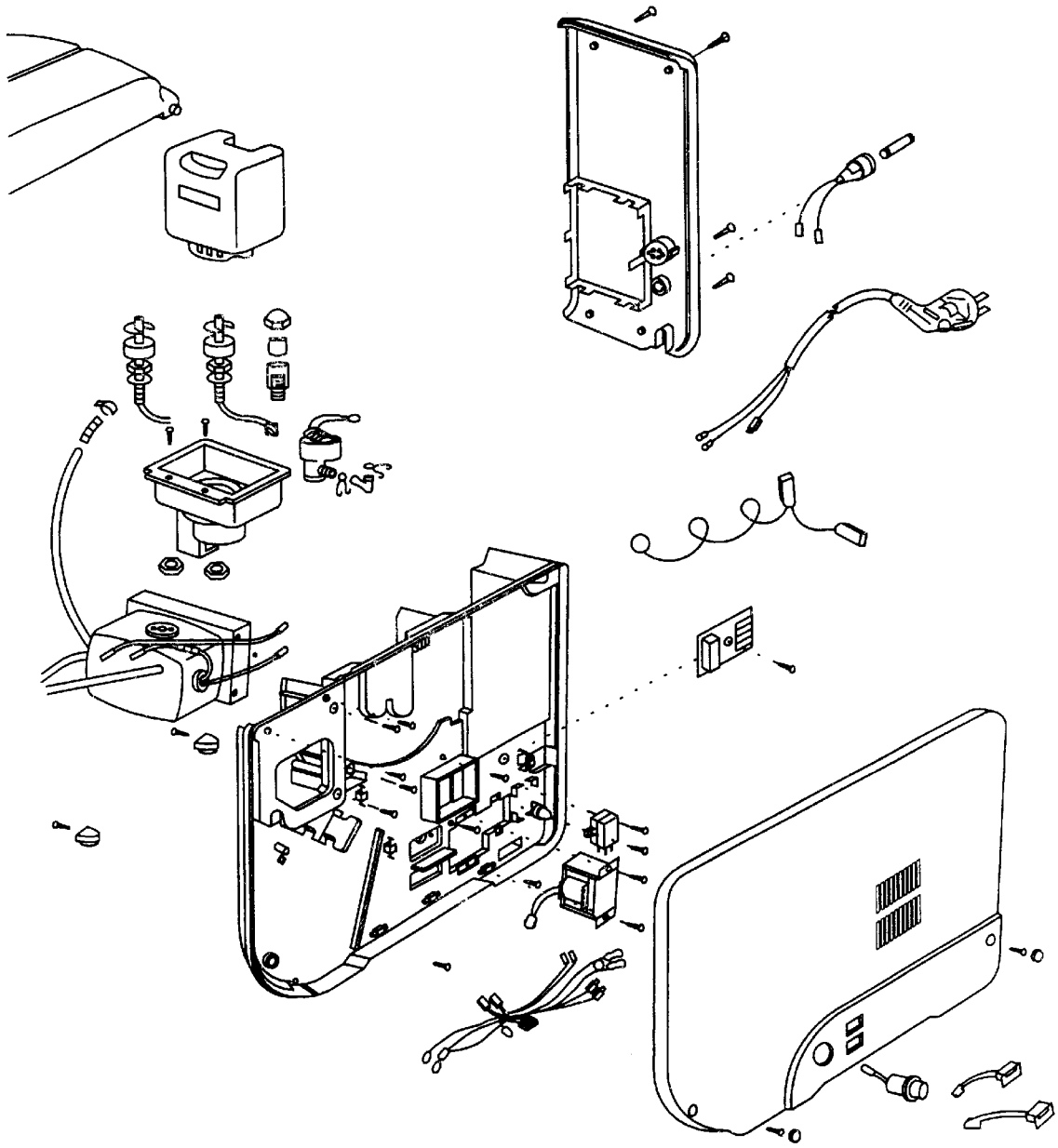
FIGS. 5 and 6 illustrate an exploded view of some of the components of an embodiment of the machine of the present invention.

FIG. 3 further shows a mechanism for applying liquid to the towels so that machine 20 can output wet towels. Further details of this mechanism are shown in FIGS. 5 and 6. In a preferred embodiment, the mechanism for applying liquid to the towels includes a liquid container 11. In a further embodiment, a filter 120 is connected to the container 11. In still a further embodiment, a sensor 122 can be connected to the container 11 to sense if the container 11 is empty. In yet a further embodiment, a sensor 124 can be included to sense either the temperature of the liquid or if the liquid is hot. Filter 120 and sensors 122 and 124 can be located in container base 10 which is connected to container 11. As is explained in more detail infra, container base 11 is removable. Base 10 is connected to a pump 9. In a further embodiment, pump 9 is connected to a liquid heating unit 7 via hose 8. The towel dispensing device of the present invention can include a heating unit if the operator desires to have heated towels. Alternatively, the towel dispensing device of the present invention can be made without a heating unit if only wet towels are desired. The heating unit 7 (or alternatively, the pump is no heater is included) is connected to cutting mechanism 1 via a hose 3 and a spraying mechanism 2 which is preferably a nozzle.

In a preferred embodiment, when the cut towel exits the cutting mechanism, it is sprayed with a liquid to produce a wet towel.

In the preferred embodiment, the liquid container 11 is made of bacteria resistant materials. Liquid container 11 can hold, for example, tap water, distilled water, or water or liquid with an antibacterial solution added thereto. The present invention is not limited to the type of liquid used in container 11 as one skilled in the art would appreciate that similar types of liquid type materials can be used effectively in the container.

In the preferred embodiment, heating unit 7 is controllable as to temperature desired for the liquid. Further, heating box is also preferable controllable so that the operator can turn on or off the heating box so that either hot or just wet towels can be output from machine 20, as desired.

In an example embodiment, heating unit 7 has an internal heating element which is 220 volts, 320 watts, and it is able to heat the liquid to a temperature between approximately 70° to 87° C. which is controlled by temperature sensor 124 and selection button 44. The present invention is not limited to this particular temperature range as the temperature can be set as needed for the end operation.

Machine 20 further includes a rolling mechanism 4, illustrated in FIG. 3, for producing a rolled wet towel. In an alternate embodiment, the towel dispensing device of the present invention can be made without a rolling mechanism and a flat, wet towel can be produced by the device. The rolling mechanism is also shown in FIGS. 6 and 7.

In the preferred embodiment, the rolling mechanism is a roller belt made of natural rubber. In a further embodiment, elements 5 and 6 also are used to roll the towels before machine 20 outputs the towels.

Figure 7:
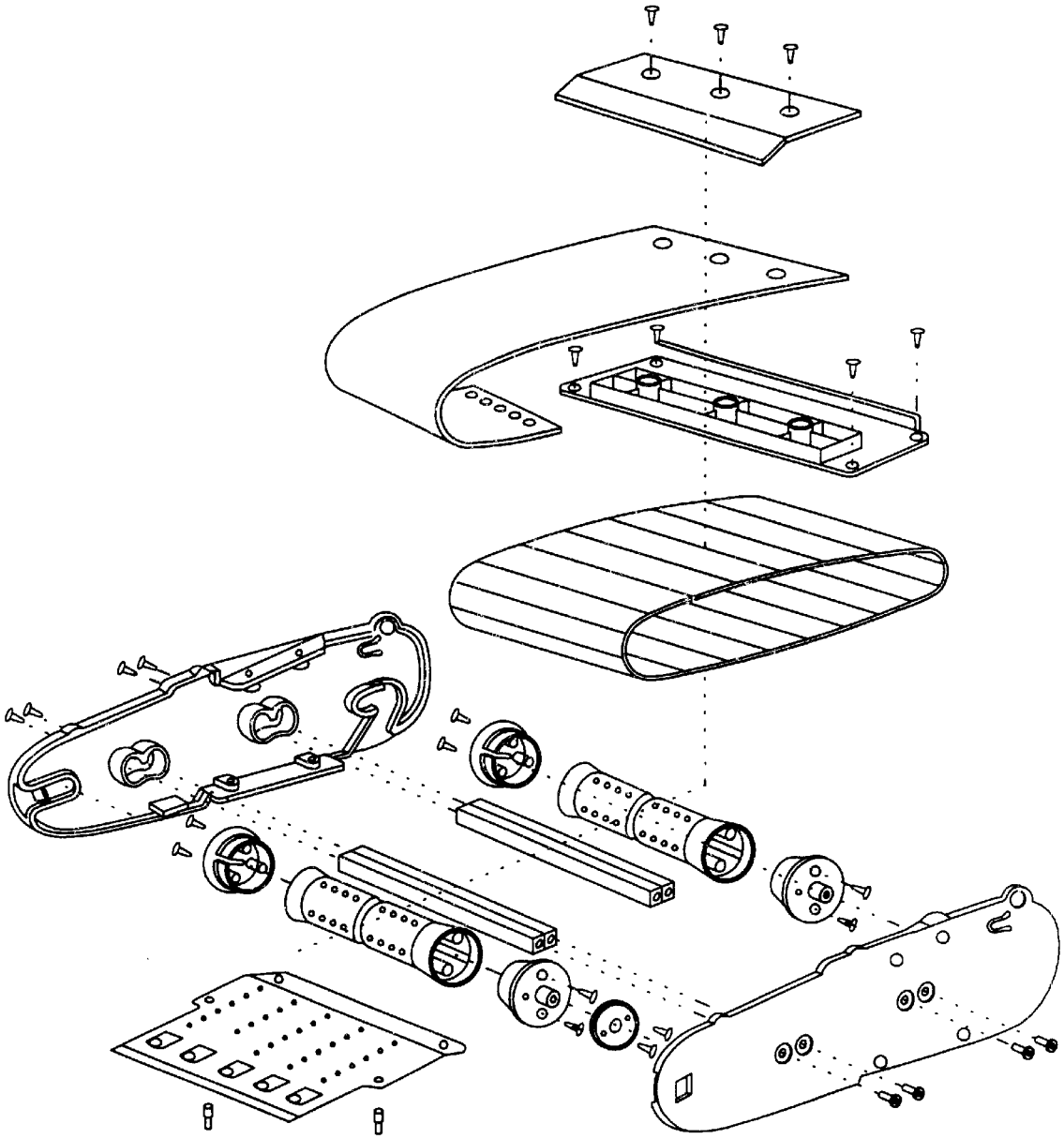
FIG. 7 illustrates an exploded view of some of the components of the conveyor or rolling mechanism of an embodiment of the machine of the present invention.

As shown in FIG. 7, rolling mechanism 4 preferably includes a conveyor belt 130, cover 132, conveyor roller 134, and gear roller 136. Rollers 134, 136 cause belt 130 to move. The wet cut towel enters under cover 132, moves along conveyor belt 130, wherein the towel is rolled up at the end of the belt. The wet rolled up towel then exits the towel dispensing device, for example, by door 138 which can be spring operated 140, through opening 22.

FIG. 4 illustrates an exterior view of the housing and various embodiments of the operation of machine 20.

FIG. 4(*a*) shows a rear view of the housing of machine 20 wherein a power cord 30 and a fuse 32 are located.

FIG. 4(*b*) shows a front view of an embodiment of the housing of machine 20 having a front panel 34 and lid 48.

As shown in FIG. 4(*b*), front panel 34 of this embodiment has buttons 24 for use by the operator to request a towel or a particular number of towels. Pushing these buttons will set the machine in operation. The buttons can be used to request one or multiple number of towels. One of the buttons can also be a cancel button. Front panel 34 also has an indicator 36. In an alternative embodiment of the present invention, indicator 34 could be used either with buttons 24 or individually as an automatic indicator to automatically request that a towel be produced without pushing any buttons. In a further alternative embodiment, the indicator light indicator 36 could also be used to indicate that the machine is in operation or that it is out of liquid.

Front panel 34 further includes towel exit 22 which includes a liquid tray 38 and a towel tray 40. Towel tray 40 is a convenience for the operator and provides a place for the towels to land when exiting machine 20. Alternatively, machine 20 could be operated without towel tray 40, and the towels would just hang down from the machine or fall out of the machine.

On the side of machine 20 in FIG. 4(*b*) is a power switch 42. In addition, there is a normal/hot selection button 44 which can be used in a further embodiment of the present invention wherein the operator can select normal for non-heated towels or hot for hot towels. This will turn on and off heating unit 7 depending on whether the operator wants hot towels or just wet towels. The present invention, however, does not require the normal/hot selection button as this is an to alternative embodiment. A further alternative embodiment to machine 20 has a nozzle cleaning button 46 for automatically cleaning spraying nozzle 2.

In a preferred embodiment of the present invention, as illustrated in FIG. 4(*b*), machine 20 has a lid 48 on top of the machine which lifts upward to provide access to the internal components and particularly fabric chamber 12 and liquid container 11. The side panel could, in an alternative embodiment (not shown), be opened to provide access to these components. The side panel could also be opened for access for cleaning and repair of the internal components of machine 20.

As shown in this embodiment, when lid 48 is opened, the operator has access to liquid container 11. FIG. 4(*c*) shows one embodiment of the present invention wherein container 11 can be removed from machine 20, filled with the appropriate liquid then turned upside down and placed back inside machine 20. This is a convenient mechanism for filling the liquid inside container 11. Alternatively, container 11 could have an opening on both ends, and liquid could be poured directly into the container while it is still in machine 20. FIG. 4(*c*) also illustrates a blow-up of a preferred embodiment showing switches 42, 44 and 46.

FIG. 4(*d*) illustrates another embodiment of the present invention when lid 48 is opened. In this embodiment, fabric roll 13 can be removed from machine 20. Preferably, fabric roll 13 has a roll of towels 14 located on a core 15. Once there are no longer any towels on core 15, it can be removed from machine 20, and either a new core 15 with a new roll of towels 14 thereon or the old core 15 with a new roll of towels 14 placed on the core, can be placed back inside fabric chamber 12. The beginning of the towel can then be pulled and placed under a towel cover 52 and into cutting mechanism 1.

FIG. 4(*e*) shows machine 20 wherein front panel 34 has been opened up to illustrate the components behind front panel 34 in an embodiment of the present invention. In this embodiment, there is a nozzle pipe 54, a carriage 56 and a liquid/water flow knob 58. Knob 58 is used to control the flow of water or other liquid from container 11 to the towels. FIG. 4(*f*) illustrates knob 58 in further detail having a nozzle knob 60. FIG. 4(*g*) shows a further embodiment wherein the rolling mechanism 4 can be removed from machine 20.

A method for producing a wet towel from a machine of a preferred embodiment of the present invention will now be described. In this method, towels are moved along a substantially continuous path through the machine 20 through a cutting mechanism 1 to cut the towels to a desired length and a liquid dispensing device applies a liquid to the surface of the towel to produce a cut, wet towel which is then dispensed from the machine.

In a further detailed embodiment, an operator pushes button 24 or activates indicator 36 to request one or more towels. The roll of towels 14 from fabric roll 13 is fed into fabric director 101 and then feed and guided through cutting mechanism 1 by transportation system 102. Cutting mechanism 1 cuts the desired length of towel and moves that towel to rolling mechanism 4. When exiting cutting mechanism 1, water or other liquid is applied, preferably by spraying, to the towel in preferably an even fashion from hose 3 at nozzle 2. The liquid comes from container 11 wherein it exits out container base 10 to pump 9 which pumps it to heater 7 via hose 8. Heater 7, if included in the device and turned on, will then heat the liquid to the desired temperature and send it through hose 3 to nozzle 2. The wet towel exiting cutting mechanism 1 then enters onto rolling mechanism 4. Rolling mechanism 4 rolls the towel and directs it to opening 22 wherein it is output to the consumer.

In the preferred embodiment, the towel is rolled and then is output from opening 22. In an alternative embodiment, the towel be output without being rolled and be rolled or not as desired by the operator.

This description has been offered for illustrative purposes only and is not intended to limit the invention of this application, which is defined in the claims below.

I claim:

1. A device for dispensing towels, said device having a housing and within said housing:

a cutting mechanism to cut said towels;

a liquid dispensing device coupled to said cutting mechanism to wet the towels, said liquid dispensing device including a liquid container, a pump and a spraying mechanism to wet said towels; and a heating unit to heat said liquid, whereby hot, wet towels are dispensed from said device.

2. The device of claim 1 wherein said cutting mechanism includes a cutting blade and rollers, wherein said rollers operate to move uncut towels through said cutting mechanism to be cut to a desired length by said cutting blade.

3. The device of claim 2 further including a motor and gears to operate said rollers to move uncut towels through said cutting mechanism.

4. The device of claim 1 wherein said heating unit is controllable so as to control the temperature of the liquid used to wet said towels.

5. The device of claim 1 wherein said container is made of a bacteria resistant material.

6. The device of claim 1 wherein said liquid in said liquid dispensing device is selected from liquids selected from the group consisting of tap water, distilled water and a liquid with an anti-bacterial solution therein.

7. The device of claim 1 further comprising a rolling mechanism inside said housing to roll said towels before they are dispensed.

8. The device of claim 7 wherein said rolling mechanism includes a conveyor belt and rollers.

9. The device of claim 1 further including at least one button to request one or more towels as desired.

10. The device of claim 1 further including a sensing mechanism, said sensing mechanism sensing movement in front of said device and automatically dispensing a towel.

11. The device of claim 1 further comprising a fabric chamber, wherein a roll of towels is held before being cut, wetted and dispensed.

12. The device of claim 11, wherein said roll of towels is on a removable core which can be removed from said device for replacement with a new roll of towels.

13. A towel dispensing device comprising:

a housing with an opening therein for dispensing a towel, wherein said device includes within the housing:

a cutting mechanism to cut towels;

a liquid dispensing device coupled to said cutting mechanism to wet said towels; and a rolling mechanism coupled to said liquid dispensing device for rolling said towels, wherein said towels are cut, wetted and rolled before being dispensed out of said opening in said housing.

14. The device of claim 13 wherein said cutting mechanism includes a cutting blade and rollers, wherein said rollers operate to move uncut towels through said cutting mechanism to be cut to a desired length by said cutting blade.

15. The device of claim 14 further including a motor and gears to operate said rollers to move uncut towels through said cutting mechanism.

16. The device of claim 14 wherein said liquid dispensing device includes a liquid container, a pump and a spraying mechanism to wet said towels.

17. The device of claim 16 wherein said container is made of a bacteria resistant material.

18. The device of claim 13 wherein said liquid in said liquid dispensing device is selected from liquids selected from the group consisting of tap water, distilled water and a liquid with an anti-bacterial solution therein.

19. The device of claim 13 wherein said rolling mechanism includes a conveyor belt and rollers.

20. The device of claim 13 further including at least one button to request one or more towels as desired.

21. The device of claim 13 further including a sensing mechanism, said sensing mechanism sensing movement in front of said device and automatically dispensing a towel.

22. The device of claim 13 further comprising a fabric chamber, wherein a roll of towels is held before being cut, wetted and dispensed.

23. The device of claim 22, wherein said roll of towels is on a removable core which can be removed from said device for replacement with a new roll of towels.

* * * * *